United States Patent [19]

Boomershine

[11] 4,387,541

[45] Jun. 14, 1983

[54] WINDOW ASSEMBLY WITH MAGNETICALLY ATTACHABLE GLAZING PANELS

[76] Inventor: Norris L. Boomershine, 1612 N. Bay Dr., Elkhart, Ind. 46514

[21] Appl. No.: 233,893

[22] Filed: Feb. 12, 1981

[51] Int. Cl.[3] ..... E06B 3/26

[52] U.S. Cl. ..... 52/202; 52/DIG. 4

[58] Field of Search ..... 52/202, 203, DIG. 4

[56] References Cited

U.S. PATENT DOCUMENTS

| | | | |
|---|---|---|---|
| 3,251,399 | 5/1966 | Grossman | 52/203 |
| 4,069,641 | 1/1978 | DeZutter | 52/202 |
| 4,182,088 | 1/1980 | Ball | 52/202 |
| 4,194,331 | 3/1980 | Gingle et al. | 52/203 |

FOREIGN PATENT DOCUMENTS

| | | | |
|---|---|---|---|
| 1573492 | 8/1980 | United Kingdom | 52/DIG. 4 |

*Primary Examiner*—James L. Ridgill, Jr.
*Attorney, Agent, or Firm*—James D. Hall

[57] ABSTRACT

A window assembly in which the glazing panel is secured to the frame of the assembly by means of magnetically attractable components. One of the magnetic components is a permanent magnetic strip applied to the window frame by means of an adhesive binder.

1 Claim, 2 Drawing Figures

WINDOW ASSEMBLY WITH MAGNETICALLY ATTACHABLE GLAZING PANELS

SUMMARY OF THE INVENTION

This invention relates to a window assembly and will have specific application to the manner in which the glazing panel of the assembly is magnetically coupled to the window frame.

In the window assembly of this invention the means of attaching the glazing panel to the peripheral frame of the assembly is improved. Heretofore, glazing panels, normally storm windows, have been applied to the frame by means of a permanent magnetic strip which is secured about the periphery of the panel and which is magnetically coupled to a steel strip attached by an adhesive to the corresponding periphery of the window frame. Sometimes due to variations in the surface of the frame or the twist in or lack of squareness of the frame an inconsistent seal is formed between the glazing panel and frame.

The window assembly forming the subject matter of this invention applies a second permanent magnetic strip which is applied to the window assembly frame by means of an adhesive binder. In the coupling between the glazing panel of the assembly which carries its own permanent magnetic strip and the magnetic strip applied to the frame of the assembly there is magnet to magnet contact. This forms a substantially consistent airtight seal about the entire periphery of the glazing panel regardless of the alignment and general outer surface condition of the frame. Additionally, the magnetic strips utilized to attach the panel to the frame are normally constructed of a flexible rubberized material which, when the strips are magnetically coupled, are in frictional contact so as to retard sliding movement of the glazing panel relative to the assembly frame.

Accordingly, it is an object of this invention to provide a window assembly which incorporates an improved means of magnetically connecting a glazing panel to the peripheral frame of the assembly.

It is also an object of this invention to provide a window assembly having a storm glazing panel which is secured in an airtight consistent peripheral seal to the frame of the window by means of magnetically coupled strips.

BRIEF DESCRIPTION OF THE DRAWINGS

A preferred embodiment of this invention has been chosen for purposes of illustration and description wherein.

DESCRIPTION OF THE PREFERRED EMBODIMENT

Figure 1:
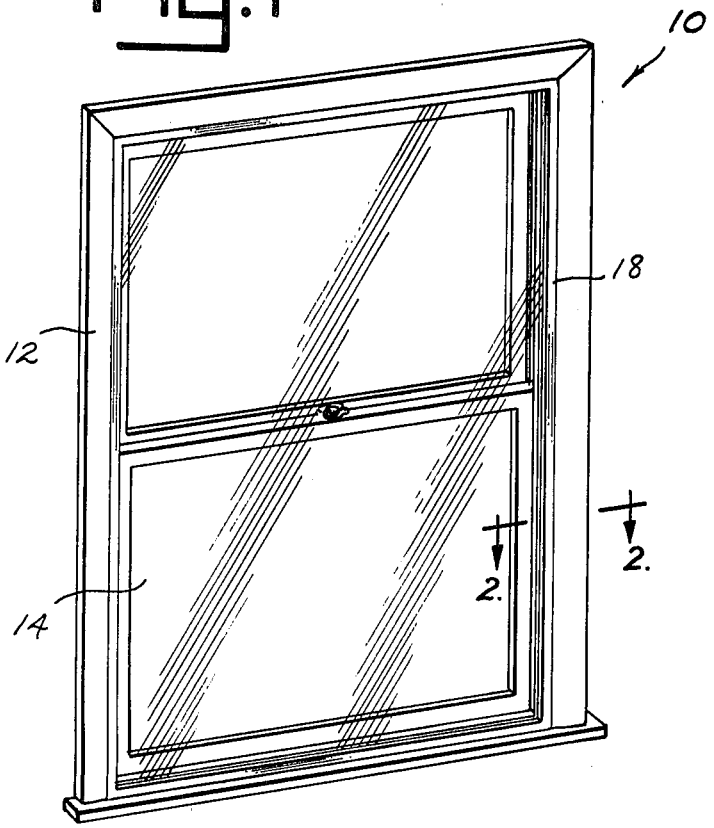
FIG. 1 is an elevational view of a window assembly.
Figure 2:
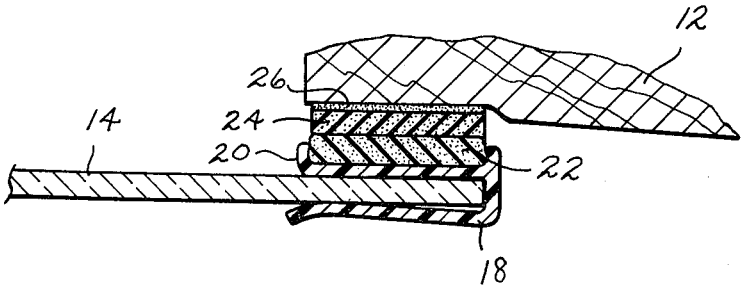
FIG. 2 is a fragmentary sectional view of the window assembly taken along line 2—2 of FIG. 1.

The preferred embodiment illustrated is not intended to be exhaustive or to limit the invention to the precise form disclosed. It is chosen and described in order to best explain the principles of the invention and its application and practical use to enable others skilled in the art to best utilize the invention.

Window assembly 10 includes a peripheral frame 12 and an interfitting, removable glazing panel 14. Frame 12 may be of a wooden, plastic, or metal construction. Glazing panel 14 may be of a glass or clear plastic construction.

A sash extends about the entire periphery of glazing panel 14 and is shown in the figures in the form of a clip 18. Clip 18 fits around the edge of panel 14 and includes a channel part 20. A strip 22 of permanent magnetic material is carried within channel part 20 of each clip 18.

A second strip 24 of permanent magnetic material is applied to the edge of frame 12 about the periphery of the window opening. Strip 24 carries an adhesive 26 at one side. Adhesive 26 is normally covered by a removable protective paper (not shown) prior to application. When it is desired to attach strip 24 to frame 12, the cover over adhesive 26 is peeled from strip 24 and the strip secured to the frame by being pressed against the frame at its adhesive backed side. Magnetic strips 22 and 24 are flexible which enables strip 24 to conform to any surface irregularities or misalignment of frame 12 and which enables panel 14 to generally accommodate the frame.

Magnetic strips 22 and 24 are compatible, that is polarized in such a manner to permit them to be magnetically coupled when glazing panel 14 carrying clip 18 about its periphery is brought into proximity with window assembly frame 12. Magnetic strips 22 and 24 carried respectively by glazing panel 14 and frame 12 are brought into contact and attracted to each other to form an airtight seal about the entire periphery of the glazing panel. Strips 22 and 24 are of an available commercial construction, normally formed of permanent magnetic particles imbedded within a rubber composition. The rubberized composition provides an area of frictional contact between strips 22 and 24 so as to retard and essentially prevent sliding movement of one strip relative to the other.

In installing glazing panel 14, strip 24 will be provided in sections so as to accommodate the peripheral outline of the window assembly frame. The improved window assembly of this invention will find utilization for doors as well as for building and housing side walls.

It is to be understood that the invention is not to be limited to the details above given, but may be modified within the scope of the appended claims.

What I claim is:

1. In a window assembly including a peripheral frame defining a window opening, a glazing panel for spanning said window opening, the dimensions of said panel being greater than the dimensions of said opening, a permanent magnetic strip secured about the periphery of said panel, the improvement comprising a compatible permanent magnetic strip having first and second sides, an adhesive binder applied at said first side of said compatible strip, said compatible magnetic strip secured about said peripheral frame by said binder, said panel attached to said peripheral frame by the magnetic attraction of said first mentioned magnetic strip and said compatible magnetic strip along the second side of the compatible magnetic strip.

* * * * *